US010737405B2

(12) United States Patent
Kim et al.

(10) Patent No.: US 10,737,405 B2
(45) Date of Patent: Aug. 11, 2020

(54) SELF-POURING MOLD SYSTEM AND METHOD OF FIRE-PROOFING, REPAIRING, AND REINFORCING USING THE SAME

(71) Applicant: KOREA INSTITUTE OF CIVIL ENGINEERING AND BUILDING TECHNOLOGY, Gyeonggi-Do (KR)

(72) Inventors: Heung Youl Kim, Seoul (KR); Bum Yeon Cho, Seoul (KR)

(73) Assignee: KOREA INSTITUTE OF CIVIL ENGINEERING AND BUILDING TECHNOLOGY, Gyeonggi-Do (KR)

( * ) Notice: Subject to any disclaimer, the term of this patent is extended or adjusted under 35 U.S.C. 154(b) by 201 days.

(21) Appl. No.: 15/849,688

(22) Filed: Dec. 21, 2017

(65) Prior Publication Data

US 2018/0223663 A1 Aug. 9, 2018

(30) Foreign Application Priority Data

Feb. 8, 2017 (KR) ..... 10-2017-0017478

(51) Int. Cl.

| | |
|---|---|
| ***B28B 13/02*** | (2006.01) |
| ***E04G 17/00*** | (2006.01) |
| ***E04G 21/04*** | (2006.01) |
| ***E04G 9/10*** | (2006.01) |
| ***E04G 11/08*** | (2006.01) |

(52) U.S. Cl.

CPC ..... *B28B 13/021* (2013.01); *E04G 9/10* (2013.01); *E04G 11/08* (2013.01); *E04G 17/002* (2013.01); *E04G 21/04* (2013.01); *E04G 21/0472* (2013.01)

(58) Field of Classification Search

CPC ..... E04G 9/10; E04G 21/04; E04G 21/0472; E04G 17/002; E04G 11/08; B28B 13/02; B28B 13/021

See application file for complete search history.

(56) References Cited

U.S. PATENT DOCUMENTS 4,881,714 A 11/1989 Koppenberg

FOREIGN PATENT DOCUMENTS

| | | |
|---|---|---|
| KR | 20000012377 | 3/2000 |
| KR | 100472603 | 3/2005 |

*Primary Examiner* — Michael Safavi

(74) *Attorney, Agent, or Firm* — JCIPRNET

(57) ABSTRACT

The present invention relates to a self-pouring mold system which ensures uniformity of a material by laterally pouring concrete into a mold installed on a side of a wall structure and minimizing a fall head generated when the concrete is poured to prevent bleeding, thereby ensuring uniformity of a fire-proofing material and adjusting a required fire-proofing coating thickness, and a method of fire-proofing, repairing, and reinforcing using the same.

11 Claims, 20 Drawing Sheets

– Prior art –

– Prior art –

– Prior art –

– Prior art –

SELF-POURING MOLD SYSTEM AND METHOD OF FIRE-PROOFING, REPAIRING, AND REINFORCING USING THE SAME

CROSS-REFERENCE TO RELATED APPLICATION

This application claims priority to and the benefit of Korean Patent Application No. 2017-0017478, filed on Feb. 8, 2017, the disclosures of which are incorporated herein by reference in its entirety.

BACKGROUND

1. Field of the Invention

The present invention relates to a self-pouring mold system and a method of fire-proofing, repairing, and reinforcing using the same and, more specifically, to a self-pouring mold system allows uniformity of a fire-proofing material to be ensured by pouring concrete at a side of a mold installed at a wall structure and minimizing a fall head generated when the concrete is poured to prevent bleeding and ensure uniformity of a material, and allows adjusting a fire-proof covering to be constructed in a required fire-proof thickness.

2. Discussion of Related Art

FIGS. 1A and 1B are installation views of an existing mold.

Before a concrete wall C is built, molds are connected to a portion in which concrete is poured. The molds are connected by a conventional connection method and structure. At a side wall portion, a side wall contact part 3*a* of a side wall mold 3 is disposed toward a side of the concrete wall C.

At the same time, both connection surface parts 3*c* are disposed to adhere to sides of the molds 1. Fixing protrusions 5*b* of a plurality of fasteners 5 are inserted into fastening holes 1*a* of the mold 1, and grooves 5*a* of the fasteners 5 are disposed to surround the side wall mold 3 and sides of molds 1 adjacent to the side wall mold 3. A conventional wedge member is inserted into a wedge insertion groove 5*c*. The fasteners 5 are coupled to the molds so that the side wall mold 3 is coupled to the adjacent molds 1.

Therefore, concrete is poured into an inner space of the molds 1 and the side wall mold 3 to construct the concrete wall C, and the concrete is generally poured through upper openings of the molds. However, in some cases, the open upper portion is not used due to interference by an existing concrete structure.

Although as not shown, concrete is poured toward sides of molds. In this case, it is not easy to check whether the concrete is poured to be airtight by visual inspection, and it is not easy to manage the quality of the concrete because the concrete is poured toward the sides.

FIGS. 1C and 1D are views illustrating installation of a side wall mold used for an existing tunnel. According to FIGS. 1C and 1D, there is provided a an uncured concrete pouring apparatus including: a plurality of molds 20, 30, 40, 50 and 60 unfolded to be continuously connected to each other or folded to be overlapped, and having edges that are successively in contact with each other when unfolded so that successively connected outer circumferential surfaces are separated a predetermined distance from an excavation surface of a tunnel to face the excavation surface; a plurality of support arms 28, 38, 48, 58 and 68 provided to elongate to correspond to the plurality of molds, each having one end strongly coupled to the molds corresponding thereto and the other end coupled to a main body to unfold the plurality of molds when the support arms are elongated and fold the molds when the support arms are compressed; and a main body 10 including a control unit for controlling the plurality of support arms and a predetermined number of wheels that enable the apparatus to move, wherein at least a part of the molds have an injection hole H for injecting the uncured concrete therethrough.

Therefore, pouring of concrete toward rear sides of the molds using the injection hole H is described, and it can be indirectly checked whether the concrete is practically poured to be airtight through an air outlet (not shown).

The mold construction is described based on a case in which a mold is installed in a tunnel cross-section shape, but a mold for a building wall is constructed the same way.

Therefore, when concrete is poured into a mold, whether the concrete is poured into the mold or toward a rear side of the mold to be airtight is checked, and then whether the concrete is evenly poured can be checked by checking whether bleeding of the poured concrete occurs, and thus, construction and quality management of a fire-proof covering for concrete is possible.

However, new quality management of concrete poured into an inside or toward a rear side of an existing mold, for example, quality management of poured concrete according to a pouring pressure, has not been introduced, but it is shown that quality of the concrete is managed by indirect construction management in the field (a method using an air outlet).

(Patent Document 1) Korean Laid-open Patent Application No. 2000-0012377 (Title of the invention: a formcrete injecting apparatus and method thereof, published on Mar. 6, 2000)

(Patent Document 2) Korean Patent No. 10-0472603 (Title of the invention: a concrete side panel and a connecting structure thereof, published on Mar. 10, 2005)

SUMMARY OF THE INVENTION

The present invention is directed to a self-pouring mold system and a method of fire-proofing, repairing, and reinforcing using the same that is capable of effectively pouring concrete by allowing an upper surface of the mold to correspond to a pouring surface while a pouring pipe installed to pass through a mold from a rear side of the mold to a front side thereof is lifted using a pouring pressure of concrete filled from a lower portion of the mold so that concrete is effectively poured and is capable of confirming whether the concrete is uniformly poured by whether the concrete bleeds so that construction and quality management for concrete fireproofing is possible.

Also, the present invention is directed to a self-pouring mold system and method of fire-proofing, repairing, and reinforcing using the same that is capable of effectively pouring concrete by allowing a pouring pipe installed to pass through a mold from a rear side of the mold to a front side thereof to be lifted using a pouring pressure of concrete filled from a lower portion of the mold so that an upper surface of the mold corresponds to a pouring surface.

According to an aspect of the present invention, there is provided a self-pouring mold system which allows a pouring pipe installed to pass through a mold from a rear side of the mold to a front side thereof to pour concrete from a lower portion of the mold so that concrete is uniformly poured without bleeding to have fire-proofing of the concrete. The self-pouring mold system includes a self-pouring apparatus installed to pass through a front panel block out part (S3) formed on the mold, a pouring pipe installed on the front side of the mold so that concrete (C) is poured through the self-pouring apparatus from the rear side of the mold, and a concrete pumping apparatus installed using an extension pipe member, wherein the mold includes a mold frame part including a central vertical opening part (S1) in which reinforcing ribs are horizontally and vertically separated from each other and intersect each other, the front panel block out part (S3) formed so that a whole front panel part is coupled to a front side thereof, and a finishing plate-upper opening part (S4) allowing the horizontal pouring finishing plate to be horizontally inserted between an upper surface of the front panel part and a lower surface of an upper plate of the mold frame part so that, when a worker pulls a horizontal hook part of the horizontal pouring finishing plate toward a rear side of the mold, a horizontal finishing plate is inserted into the finishing plate-upper opening part (S4) so that the horizontal pouring finishing plate is not exposed to the front side of the mold.

According to another aspect of the present invention, there is provided a method of fire-proofing, repairing, and reinforcing using a self-pouring mold system including (a) providing a self-pouring mold system (A), (b) supplying concrete to a pouring pipe using a concrete pumping apparatus, and (c) inserting a vertical pouring finishing plate of a self-pouring apparatus toward a rear side of a mold, wherein the self-pouring mold system A in operation a includes a self-pouring mold apparatus installed to pass through a front panel block out part (S3) formed on the mold, and a pouring pipe installed so that concrete C is poured toward a front side of the mold from a rear side of the mold through the self-pouring mold apparatus, wherein the self-pouring mold apparatus includes a horizontal pouring finishing plate including a horizontal finishing plate set to the front side of the mold, and a horizontal hook part extending from the horizontal finishing plate toward the rear side of the mold through the front panel block out part (S3), vertical guide units transversely separated from each other on the rear side of the mold so that the front panel block out part (S3) is positioned as an opening, and installed to extend vertically, a vertical pouring finishing plate set to the front side of the mold to finish the front panel block out part (S3) so that the horizontal hook part is supported on an upper side thereof from the rear side of the mold, and formed so that the pouring pipe passes therethrough, and a middle pouring pipe bracket positioned by both vertical guide units and set to be in contact with a rear side of the vertical pouring finishing plate so that the horizontal hook part is supported on an upper side thereof from the rear side of the mold, and formed so that the pouring pipe passes therethrough, when concrete is supplied to the pouring pipe, the concrete (C) is poured toward the front side of a front panel part of the mold and rises, and the horizontal pouring finishing plate is lifted by a concrete pouring pressure, and thus, the method allows fire-proofing of the concrete to be performed by allowing the concrete to be poured from a lower portion of the mold using the pouring pipe installed to pass through the mold from the rear side thereof to the front side thereof to be uniformly poured without bleeding.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIGS. 2G, 2H, 2I and 2J is an exploded installation and structural view of a self-pouring apparatus of the embodiment of the present invention;

DETAILED DESCRIPTION OF EXEMPLARY EMBODIMENTS

Figure 1A:
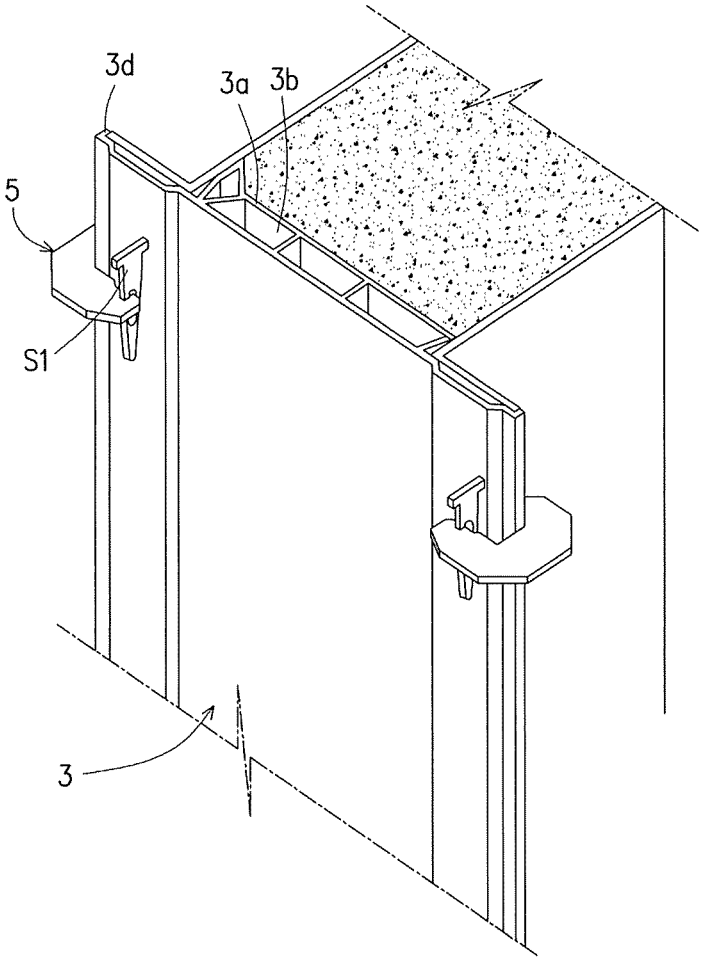
FIGS. 1A to 1D are installation views of an existing mold.
Figure 1B:
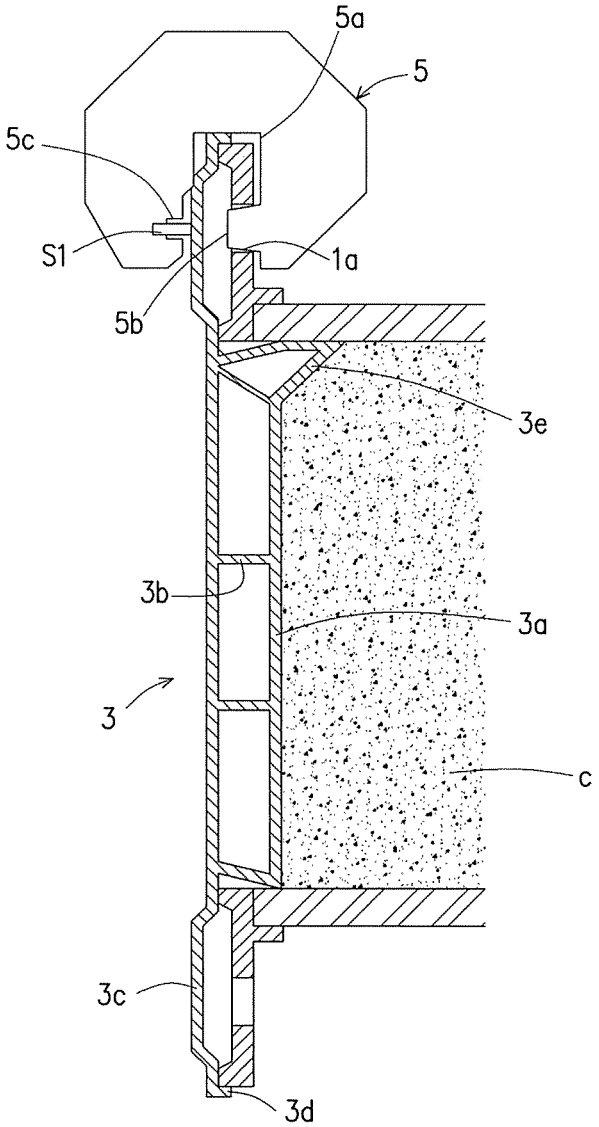
Figure 1C:
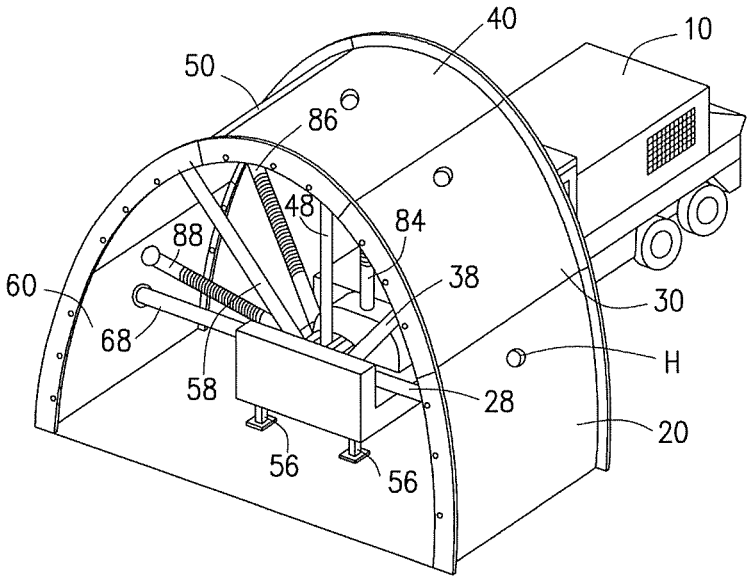
Figure 1D:
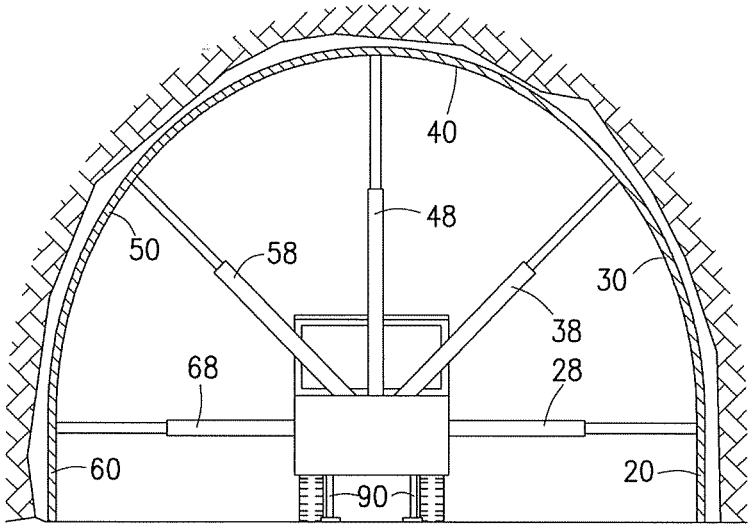

Exemplary embodiments of the present invention will be described in detail below with reference to the accompanying drawings. While the present invention is shown and described in connection with exemplary embodiments thereof, it should be apparent to those skilled in the art that various modifications can be made without departing from the spirit and scope of the invention.

Hereinafter, embodiments that are easily performed by those skilled in the art will be described in detail with reference to the accompanying drawings. However, embodiments of the present invention may be implemented in several different forms and are not limited to embodiments described herein. In addition, parts irrelevant to description are omitted in the drawings in order to clearly explain embodiments of the present invention. Similar parts are denoted by similar reference numerals throughout this specification.

Throughout this specification, when a certain part "includes" a certain component, it means that another component may be further included and not that another part is excluded unless otherwise defined.

Self-Pouring Mold System A of the Present Invention

Figure 2A:
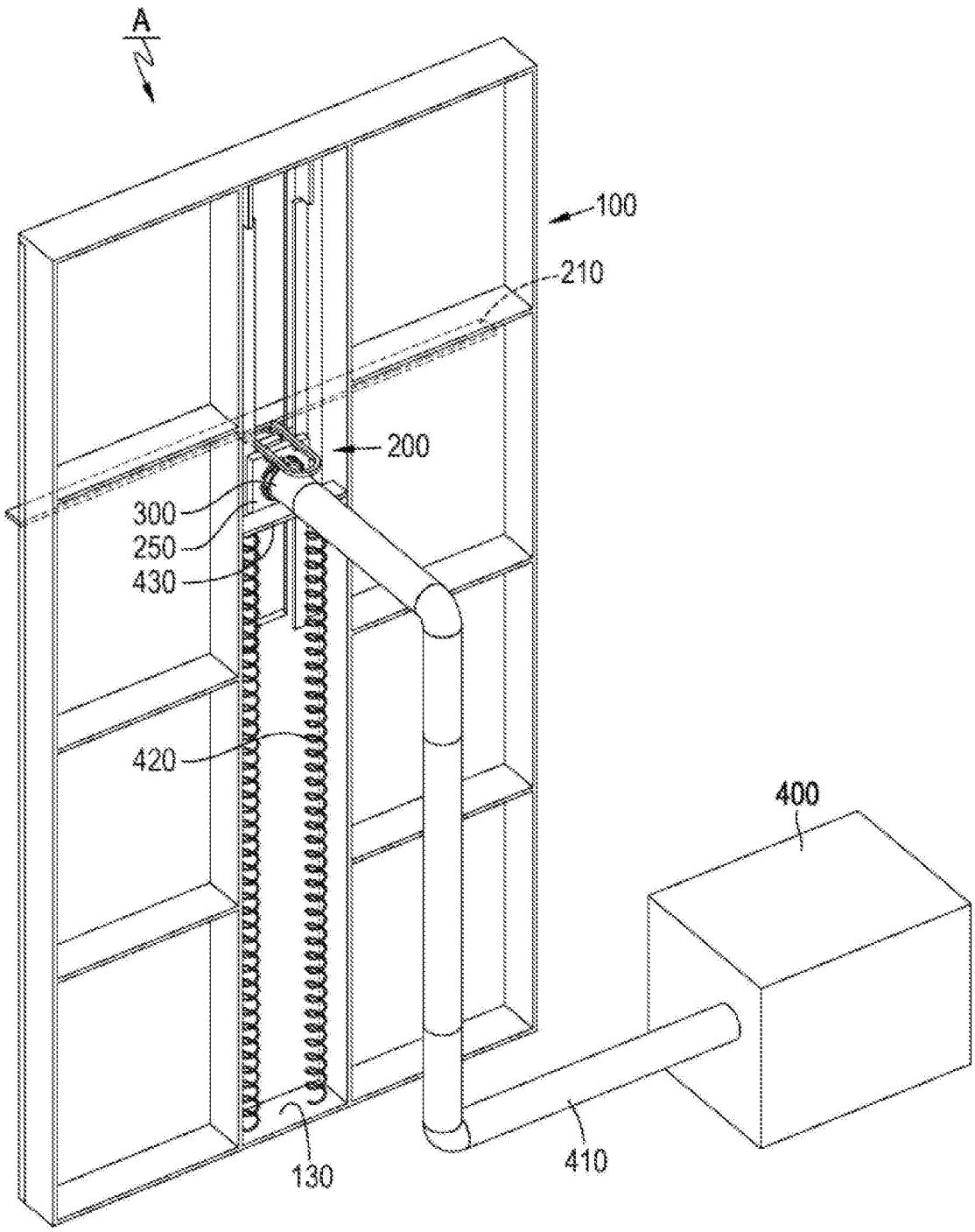
FIG. 2A is a configuration view of a self-pouring mold system (A) of an embodiment of the present invention.
Figure 2B:
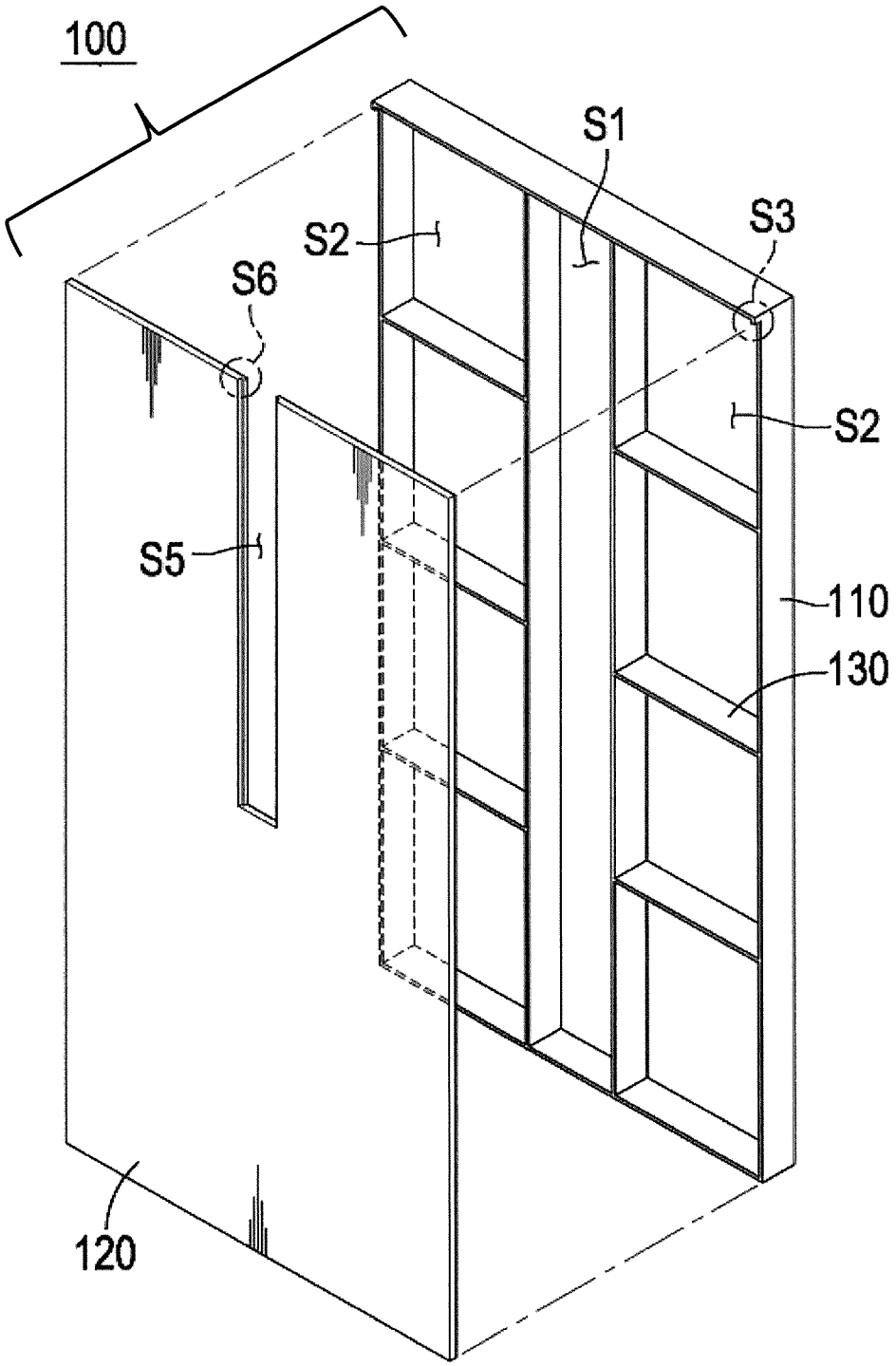
FIGS. 2B, 2C, 2D, 2E and 2F are perspective views of the self-pouring mold system (A) of the embodiment of the present invention.
Figure 2C:
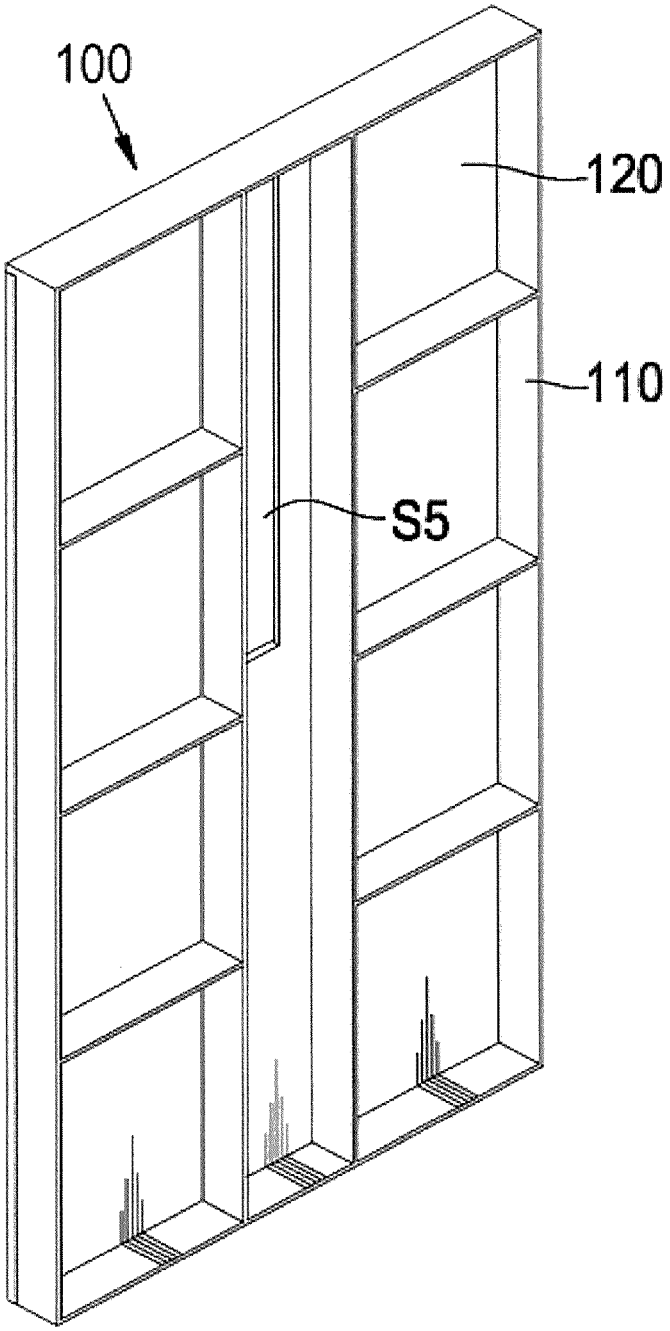
Figure 2D:
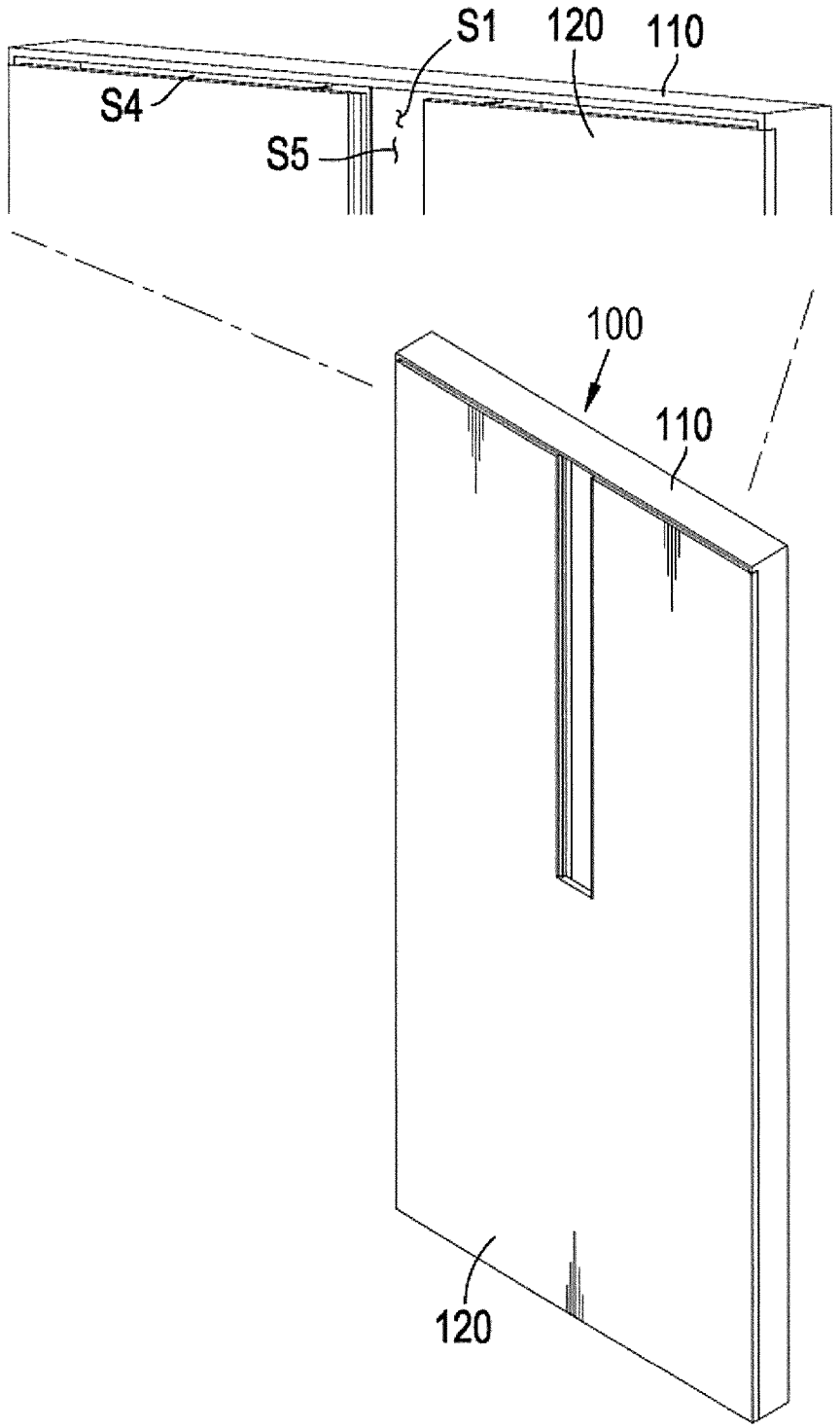
Figure 2E:
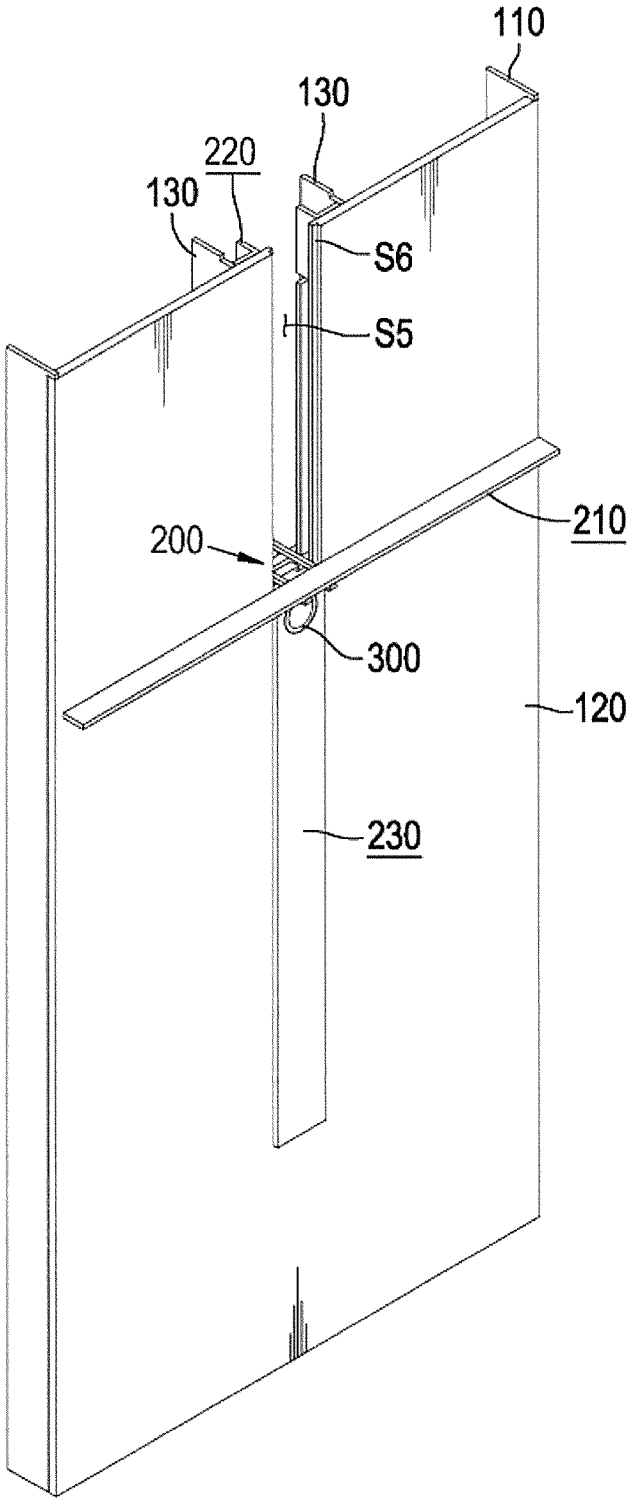
Figure 2F:
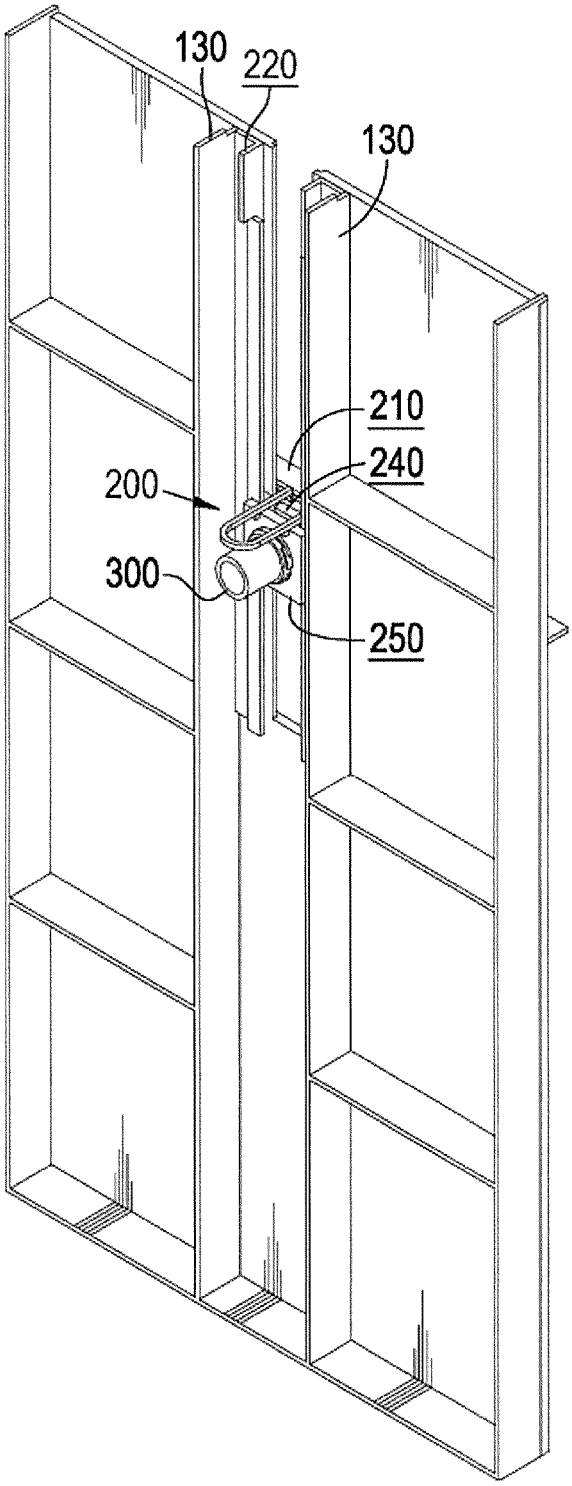
Figure 2G:
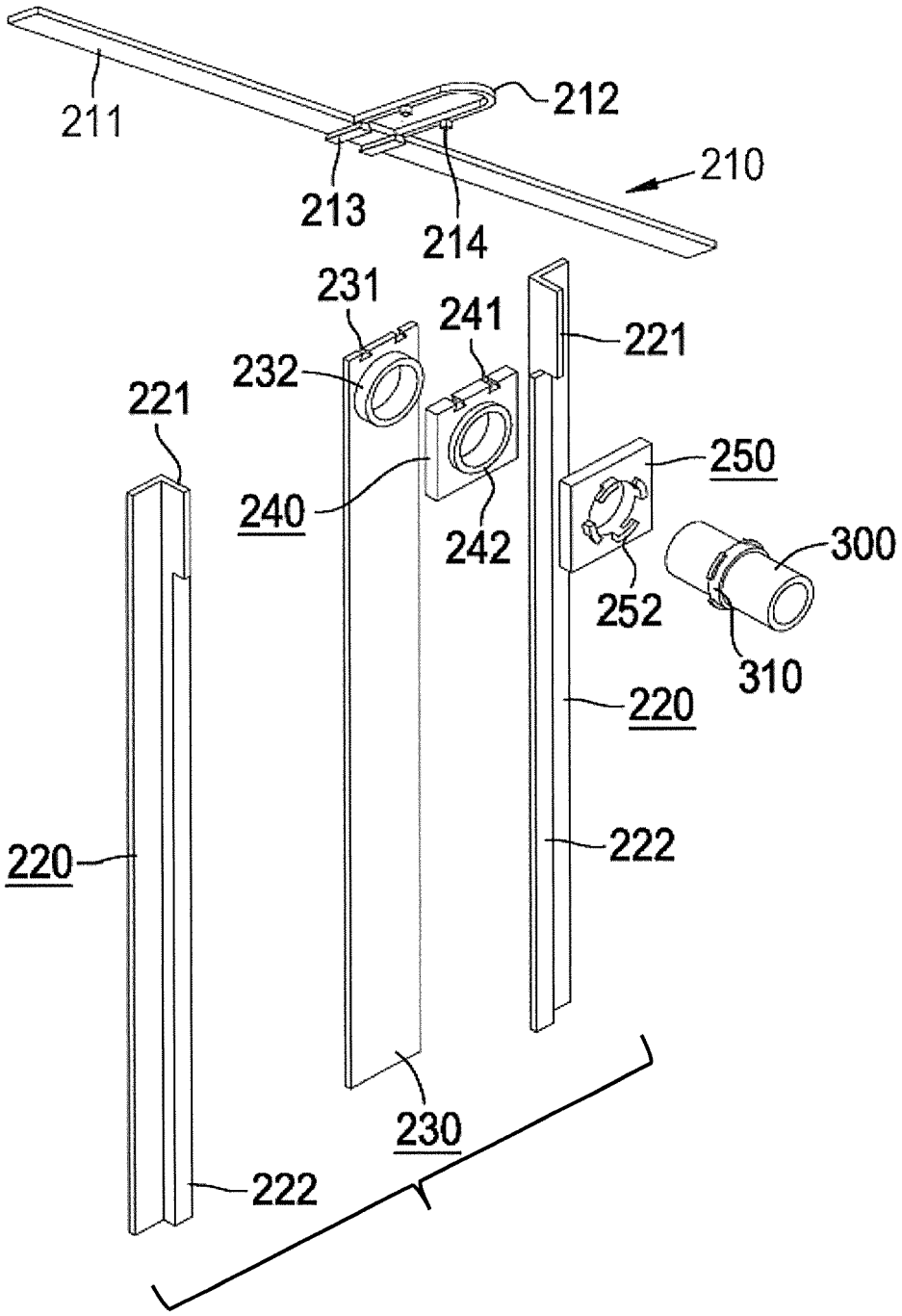
Figure 2H:
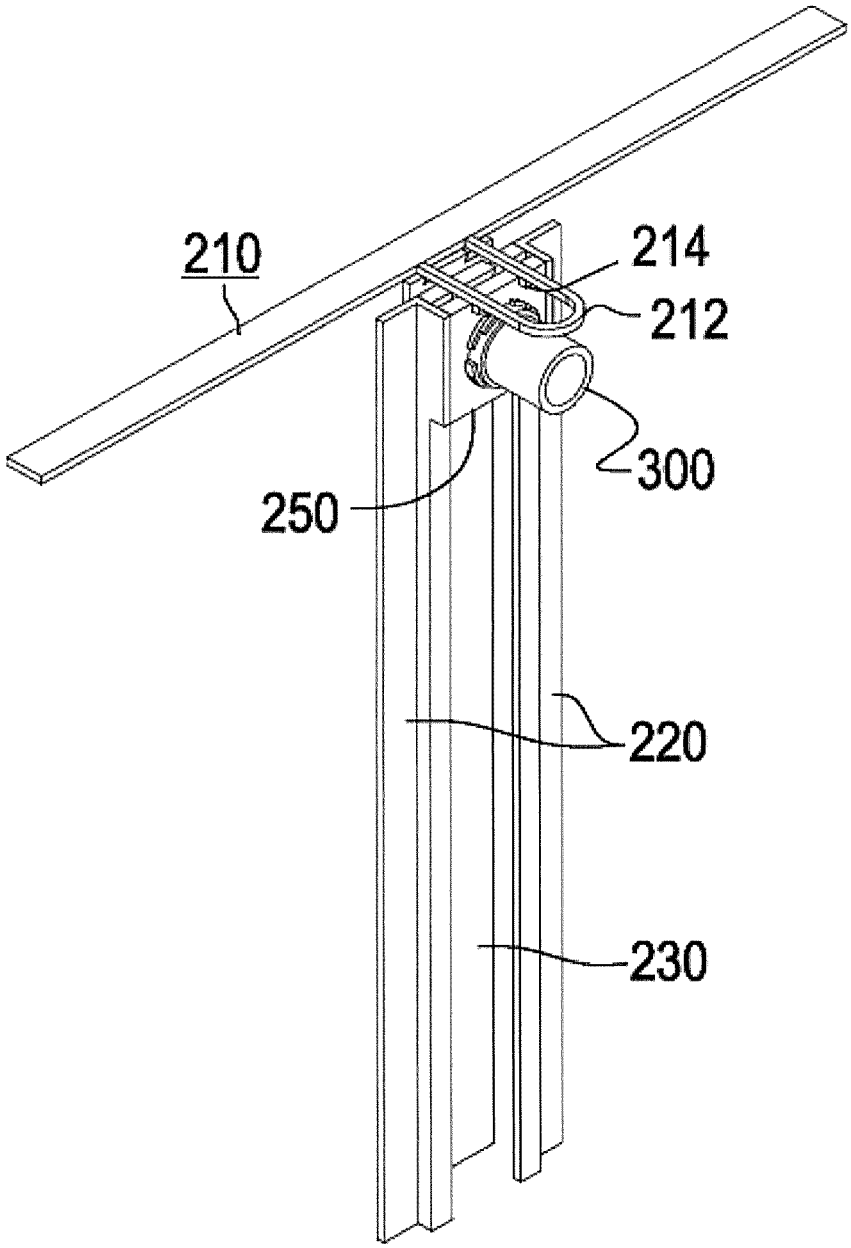
Figure 21:
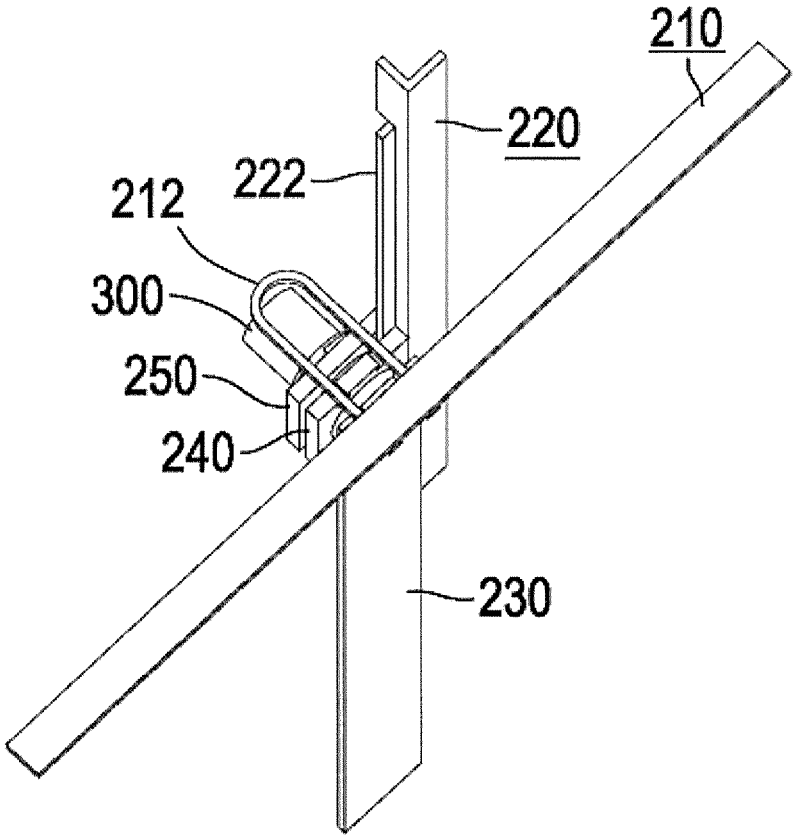
Figure 2J:
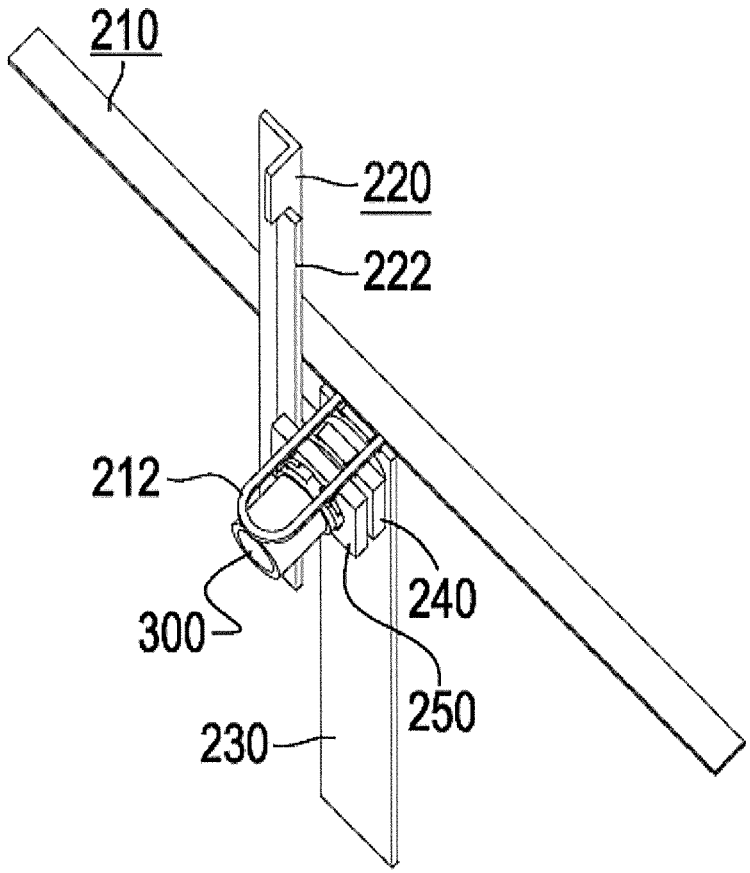
Figure 2K:
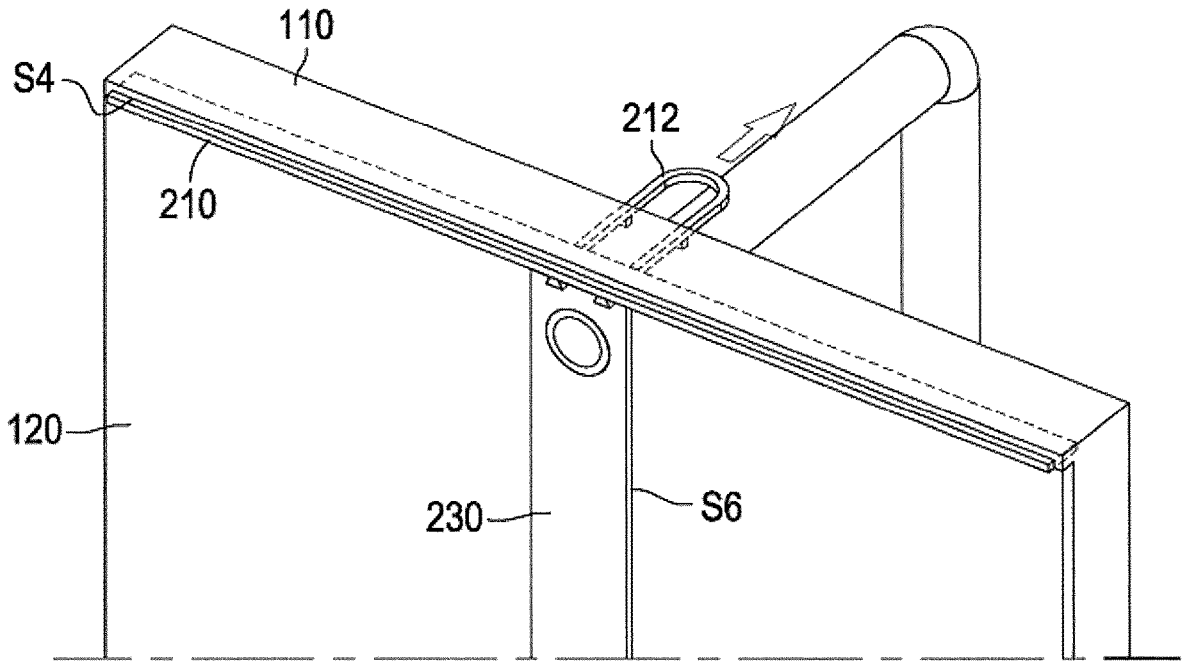
FIGS. 2K and 2L is an application view of a vertical pouring finishing plate of the self-pouring mold system (A) of the embodiment of the present invention.
Figure 2L:
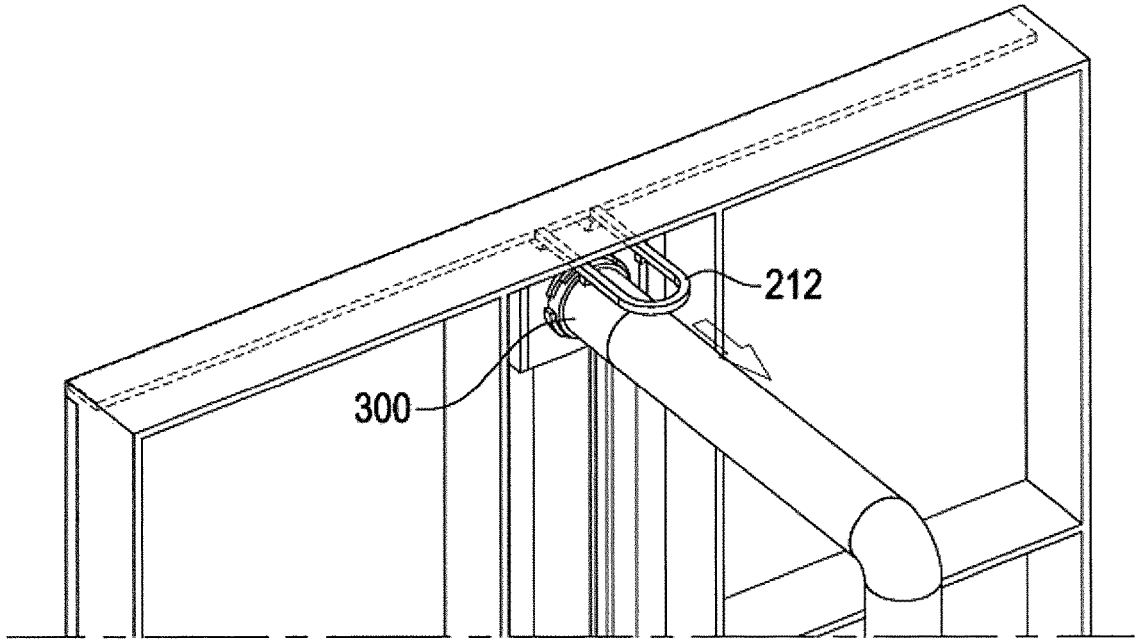

FIG. 2A is a configuration view of a self-pouring mold system A of an embodiment of the present invention, FIGS. 2B, 2C, 2D, 2E, and 2F are perspective views illustrating a structure of the self-pouring mold system A of the embodiment of the present invention, FIGS. 2G, 2H, 2I and 2J is an extracted installation and structural view of a self-pouring apparatus 200, and FIGS. 2K and 2L is an application view of a horizontal pouring finishing plate 210 of the self-pouring mold system A of the embodiment of the present invention.

As shown in FIG. 2A, the self-pouring mold system A includes a mold 100, the self-pouring apparatus 200, and a pouring pipe 300.

As shown in FIGS. 2B-2D, the mold 100 which is a steel mold includes a front panel part 120 and a mold frame part 110 including reinforcing ribs 130.

As shown in FIGS. 2B-2D, the mold frame part 110 includes the reinforcing ribs 130, wherein the reinforcing ribs 130 are formed to horizontally and vertically cross each other and be separated from each other in a rectangular steel edge panel to form a central vertical opening part S1 and a plurality of side opening parts S2 around the central vertical opening part S1.

Also, a front panel block out part S3 is formed so that the whole front panel part 120 is coupled to a front of the mold frame part 110, and the front panel part 120 is formed to be inserted into the front panel block out part S3 of the the mold frame part 110 so that the front part of the mold frame part 110 is not stepped.

Also, a finishing plate-upper opening part S4 is formed so that a horizontal pouring finishing plate 210, which will be described below, is horizontally inserted between an upper side of the front panel part 120 and a lower side of an upper plate of the mold frame part 110.

Therefore, the front panel part 120 is in direct contact with concrete poured toward the front panel part 120, and a concrete finishing surface is effectively formed.

Next, the front panel part 120 is made of steel, has an upper central vertical opening part S5 cut downward from an upper central portion thereof to communicate with the central vertical opening part S1, and has a smaller width than the central vertical opening part S1.

Also, as shown in FIGS. 2B-2F, a vertical guide block out part S6 is formed in the upper central vertical opening part S5 to be stepped, and a vertical pouring finishing plate 230, which will be described below, is inserted into the upper central vertical opening part S5 so that the vertical pouring finishing plate 230 and the front panel part 120 are formed to be vertically coplanar.

As shown in FIGS. 2E-2J, the self-pouring apparatus 200 includes the horizontal pouring finishing plate 210, vertical guide units 220, the vertical pouring finishing plate 230, a middle pouring pipe bracket 240, and a rear pouring pipe bracket 250.

As shown in FIGS. 2G-2J, the horizontal pouring finishing plate 210 includes a horizontal finishing plate 211, a horizontal hook part 212, insertion holding parts 213, and a fixed holding part 214.

As shown in FIGS. 2G-2J, the horizontal pouring finishing plate 210 is set to be placed on upper sides of the vertical pouring finishing plate 230, the middle pouring pipe bracket 240, and the rear pouring pipe bracket 250.

As shown in FIGS. 2G-2J and 4A-4B, the horizontal finishing plate 211 is located above the pouring pipe 300, through which concrete C poured toward the front panel part 120 is injected, and is formed so that a horizontal extension length thereof corresponds to a width of the front panel part 120 as a horizontal panel finishing an upper surface of the poured concrete.

As shown in FIGS. 2G-2J, the insertion holding parts 213 are separated from each other and protrude downward from a lower central side of the horizontal finishing plate 211 to be set to be horizontally inserted into holding grooves 231 and 241 formed on upper sides of the vertical pouring finishing plate 230 and the middle pouring pipe bracket 240.

As shown in FIGS. 2G-2J, the horizontal hook part 212 is formed to be horizontally extended in a U-shaped on the central rear side of the horizontal finishing plate 211, and the fixed holding part 214 protrudes from a lower side of the horizontal hook part 212 on the same line as the insertion holding parts 213 to be fixedly caught by a top of the rear pouring pipe bracket 250, which will be described below.

Therefore, as shown in FIGS. 2K-2L, when a worker horizontally pulls the horizontal hook part 212 toward a rear side of the mold 100, the horizontal finishing plate 211 is guided by the holding grooves 231 and 241 on the above-described finishing plate-upper opening part S4 of the front panel part 120 and is horizontally inserted therein.

As shown in FIGS. 2E-2J, the vertical guide units 220 are vertical channel members, are positioned so that upper surfaces thereof face an upper surface of the central vertical opening part S1 of the the mold frame part 110, and are installed on sides of the reinforcing ribs 130 that are positioned in the center to face each other. The upper central vertical opening part S5 is formed between the vertical guide units 220. The vertical guide units 220 are separated from each other on the rear of the front panel part 120 and guide vertical movement of the self-pouring apparatus 200.

As shown in FIGS. 2E-2J, the vertical guide units 220 are formed so that vertical channel members with an L-shaped cross-section extend downward, wherein upper ends thereof are formed as an upper vertical guide unit 221 configured to accommodate the middle pouring pipe bracket 240 and the rear pouring pipe bracket 250 therein. A horizontal guide unit 222 extends downward from a lower surface of the upper vertical guide unit 221 and, as shown in FIGS. 2G-2J, is inserted between the middle pouring pipe bracket 240 and the rear pouring pipe bracket 250.

Therefore, as shown in FIGS. 2G-2J, the middle pouring pipe bracket 240 and the rear pouring pipe bracket 250 that are bound by the pouring pipe 300 passing therethrough are vertically moved along the vertical guide units 220 to also vertically move and guide the horizontal pouring finishing plate 210 and the vertical pouring finishing plate 230 together.

In this case, heights of the vertical guide units 220 are slightly greater than a height of the upper central vertical opening part S5 formed on the front panel part 120.

As shown in FIGS. 2E-2J, the vertical pouring finishing plate 230 has a vertical plate shape and has the holding groove 231 formed on the top thereof and a pouring pipe flange part 232 formed to protrude on a rear side thereof so that the pouring pipe 300 passes therethrough.

As shown in FIGS. 2E-2F, the vertical pouring finishing plate 230 is set to be attached at the vertical guide block out part S6 of the upper central vertical opening part S5 formed on the front panel part 120 to be vertically moved and bound by the horizontal hook part 212, and is inserted into the vertical guide block out part S6 by the horizontal hook part 212 being pulled toward the rear side of the mold.

Therefore, the poured concrete does not leak toward the upper central vertical opening part S5 of the front panel part 120.

In this case, a height of the vertical pouring finishing plate 230 is formed to correspond to the height of the upper central vertical opening part S5 formed on above-described the front panel part 120.

As shown in FIGS. 2E-2J, the middle pouring pipe bracket 240 has a rectangular shape and has a pouring pipe flange part 242 formed at a rear side thereof to protrude so that the pouring pipe 300 passes therethrough.

As shown in FIGS. 2E-2J, a clamping fixture 252 is formed on the rear side of the rear pouring pipe bracket 250 to protrude so that the pouring pipe 300 passes therethrough.

Therefore, the pouring pipe flange part 242 of the middle pouring pipe bracket 240 is in contact with a front side of the rear pouring pipe bracket 250 and is separated from the front side thereof, and the pouring pipe flange part 242 and the clamping fixture 252 are set to communicate with each other.

As shown in FIGS. 2G-2J, the horizontal guide unit 222 of the vertical guide units 220 is set to be inserted between the middle pouring pipe bracket 240 and the rear pouring pipe bracket 250.

That is, as shown in FIGS. 2G-2J, the front side of the middle pouring pipe bracket 240 is in contact with the pouring pipe flange part 232 of the vertical pouring finishing plate 230, and the front side of the pouring pipe flange part 242 is in contact with the front side of the rear pouring pipe bracket 250.

The holding groove 241 is formed in an upper side of the middle pouring pipe bracket 240, and the horizontal hook part 212 is horizontally inserted therein by the insertion holding parts 213 of the horizontal pouring finishing plate 210.

Referring to FIGS. 2E-2J, in this case, a holding groove is not formed in an upper surface of the rear pouring pipe bracket 250 unlike the middle pouring pipe bracket 240, and the clamping fixture 252 is separately formed on a rear surface of the rear pouring pipe bracket 250 to be fixedly fastened to the pouring pipe 300. The fastening fixture 310 inserted into the pouring pipe 300 is rotatably fastened thereto.

As shown in FIG. 2A, the pouring pipe 300 is a pipe member for pouring the concrete C into the front panel part 120 of the mold 100 and is installed to pass through the rear pouring pipe bracket 250, the middle pouring pipe bracket 240, and the vertical pouring finishing plate 230, thereby binding the rear pouring pipe bracket 250, the middle pouring pipe bracket 240, and the vertical pouring finishing plate 230 to vertically move together.

The pouring pipe 300 is connected to a concrete pumping apparatus 400 using an extension pipe member 410. The fastening fixture 310 is inserted into the pouring pipe 300 and is rotatably fastened to the clamping fixture 252 of the rear pouring pipe bracket 250.

Figure 3:
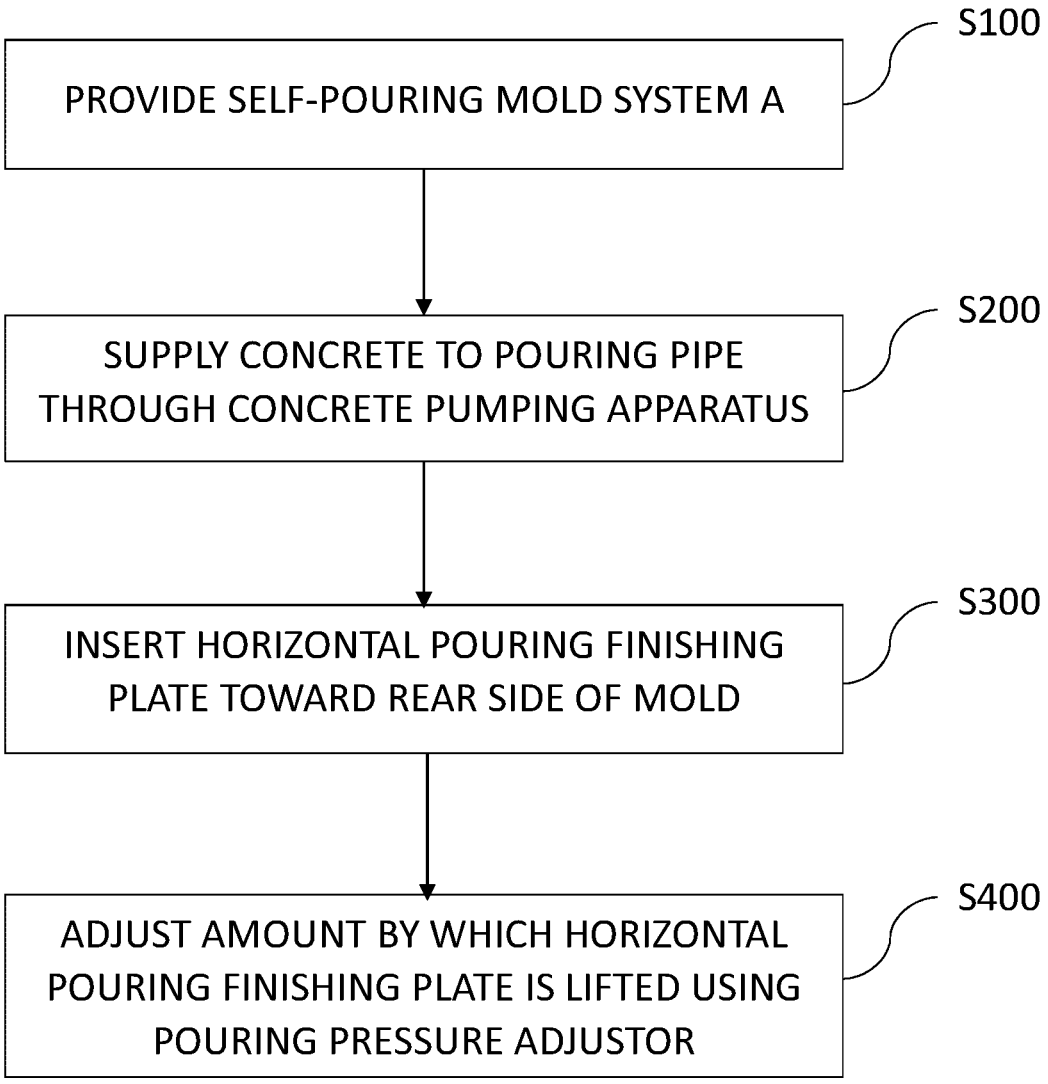
FIG. 3 is a flowchart of a method of fire-proofing, repairing, and reinforcing using the self-pouring mold system of the embodiment of the present invention.

Method of Fire-Proofing, Repairing, and Reinforcing Using a Self-Pouring Mold System of an Embodiment of the Present Invention FIG. 3 is a flowchart of method of fire-proofing, repairing, and reinforcing using the self-pouring mold system of the embodiment of the present invention, and FIGS. 4A-4D are state views illustrating poured concrete of the self-pouring mold system A of the embodiment of the present invention.

As shown in FIG. 3, the self-pouring mold system A is provided (S100).

Figure 4A:
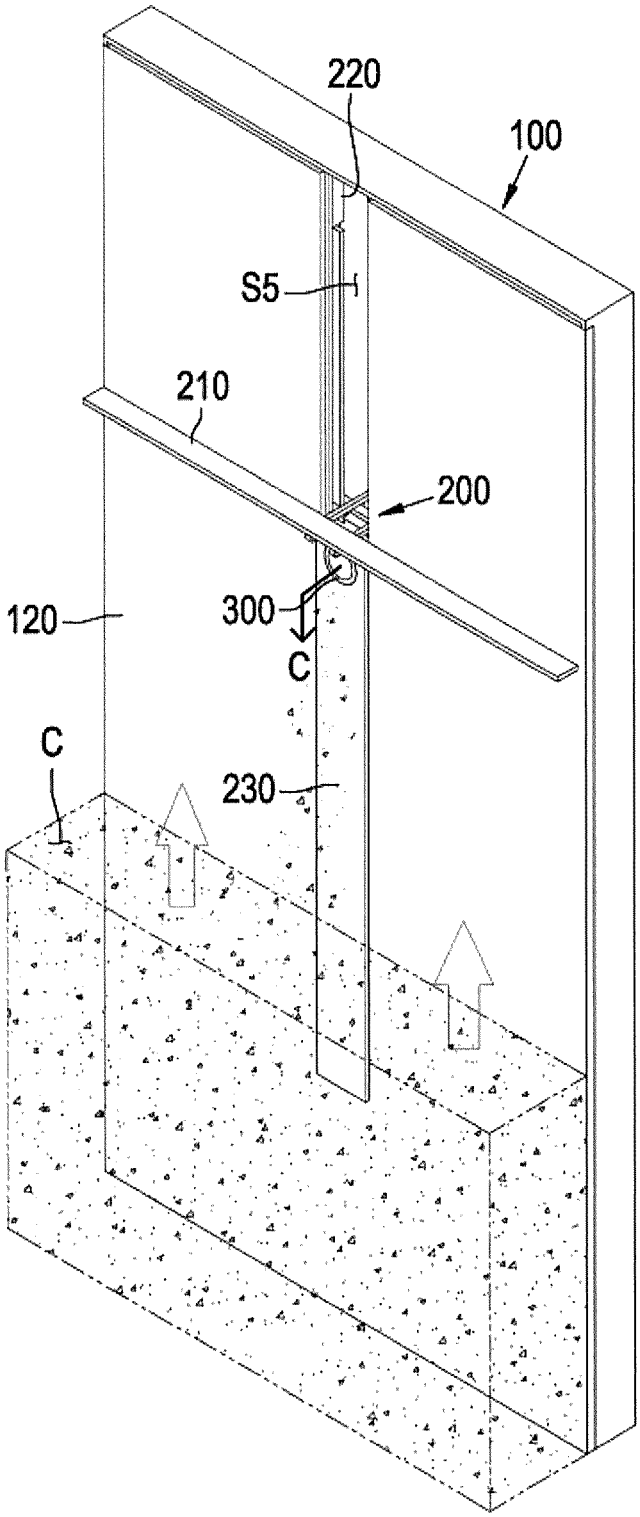
FIGS. 4A-4D are state views illustrating poured concrete of the self-pouring mold system (A) of the embodiment of the present invention.
Figure 4B:
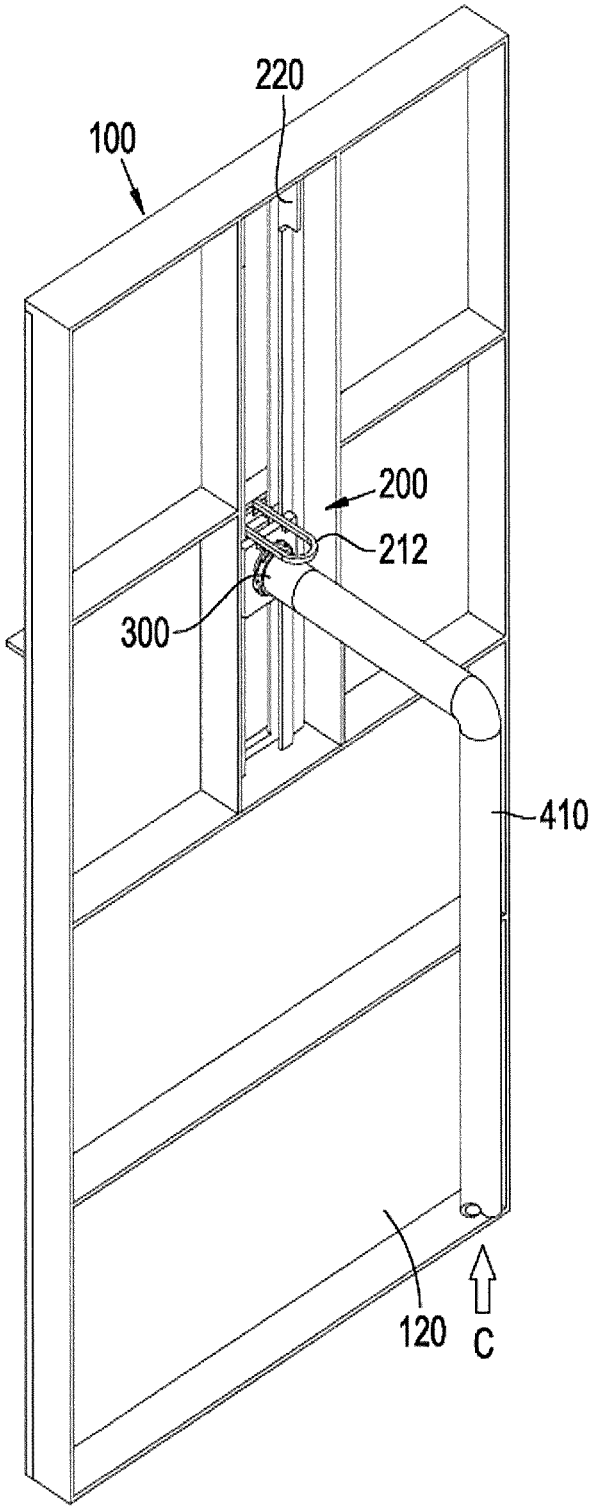

Referring to FIGS. 4A-4B, it can be seen that the self-pouring apparatus 200 is initially set in the mold 100.

That is, the upper central vertical opening part S5 is exposed toward a front of the front panel part 120 as an opening, and the horizontal pouring finishing plate 210 set by the vertical guide units 220 of the self-pouring apparatus 200 protrudes from a lower end of the upper central vertical opening part S5.

Also, the vertical pouring finishing plate 230 of the self-pouring apparatus 200 is slightly separated from the front of the front panel part 120, and a front side of the pouring pipe 300 is exposed to an upper end of the vertical pouring finishing plate 230.

Therefore, the vertical guide units 220 are exposed to the rear side of the front panel part 120, and the horizontal hook part 212 of the horizontal pouring finishing plate 210 is exposed. The pouring pipe 300 is also exposed to pass through the middle pouring pipe bracket 240, the rear pouring pipe bracket 250, and the vertical pouring finishing plate 230.

Also, as shown in FIGS. 2G-2J, the insertion holding parts 213 of the horizontal pouring finishing plate 210 are inserted into the holding grooves 231 and 241 of the vertical pouring finishing plate 230 and the middle pouring pipe bracket 240, and the fixed holding part 214 is caught at the top of the rear pouring pipe bracket 250.

The pouring pipe 300 is connected to the concrete pumping apparatus 400 by the extension pipe member 410.

Next, as shown in FIG. 3, concrete is supplied to the pouring pipe 300 through the concrete pumping apparatus 400 of the self-pouring mold system A (S200).

That is, as shown in FIGS. 4A-4B, when concrete is supplied to the pouring pipe 300 through the concrete pumping apparatus 400, concrete C is poured toward the front of the front panel part 120 of the mold 100. When the concrete rises from a lower portion of the front panel part, the concrete rises up toward the lower surface of the horizontal pouring finishing plate 210.

Therefore, the lower side of the horizontal pouring finishing plate 210 rises due to a pouring pressure caused by continuously pouring the concrete, which is applied as a force that lifts the self-pouring apparatus 200.

In the present invention, self-pouring refers to concrete being poured toward the front side of the front panel part 120 while the self-pouring apparatus 200 rises due to the pouring pressure.

In this case, the pouring pipe 300 passes through the the horizontal pouring finishing plate 210, the vertical pouring finishing plate 230, the middle pouring pipe bracket 240, and the rear pouring pipe bracket 250 of the self-pouring apparatus 200 to be lifted together therewith.

Positions of the vertical pouring finishing plate 230, the middle pouring pipe bracket 240, and the rear pouring pipe bracket 250 are guided by the vertical guide units 220 and are lifted at the same time.

The horizontal pouring finishing plate 210 is bound by the holding grooves 231 and 241, the insertion holding parts 213, and the fixed holding part 214 and is placed on upper surfaces of the vertical pouring finishing plate 230, the middle pouring pipe bracket 240, and the rear pouring pipe bracket 250.

Therefore, the insertion holding parts 213 horizontally inserted into the holding grooves 231 and 241 have a triangular or inverted-triangular cross-section to be vertically bound to each other after the insertion holding parts 213 are horizontally inserted therein.

As shown in FIG. 3, the horizontal pouring finishing plate 210 of the self-pouring mold system A protrudes toward the front side of the the mold 100 and is inserted into the rear side of the mold 100 so as not to protrude (S300).

Figure 4C:
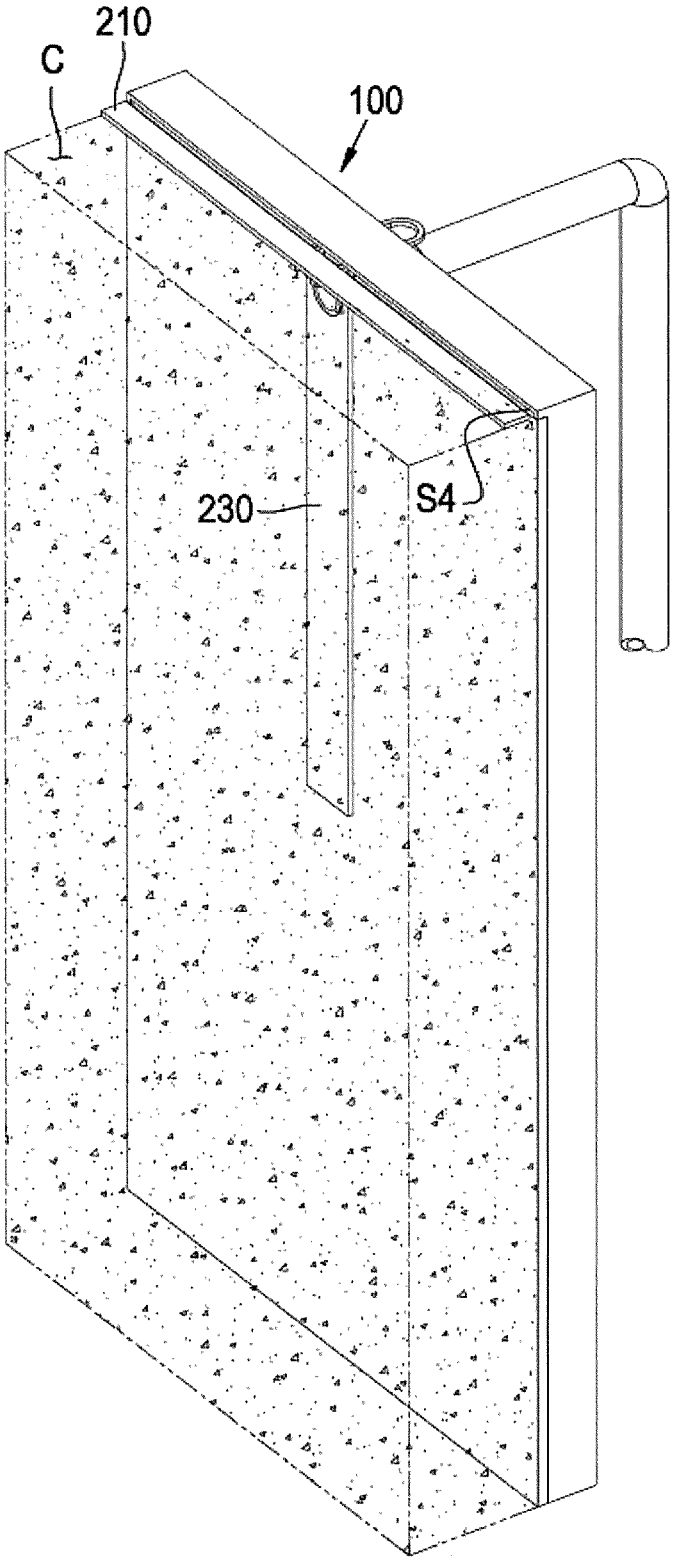
Figure 4D:
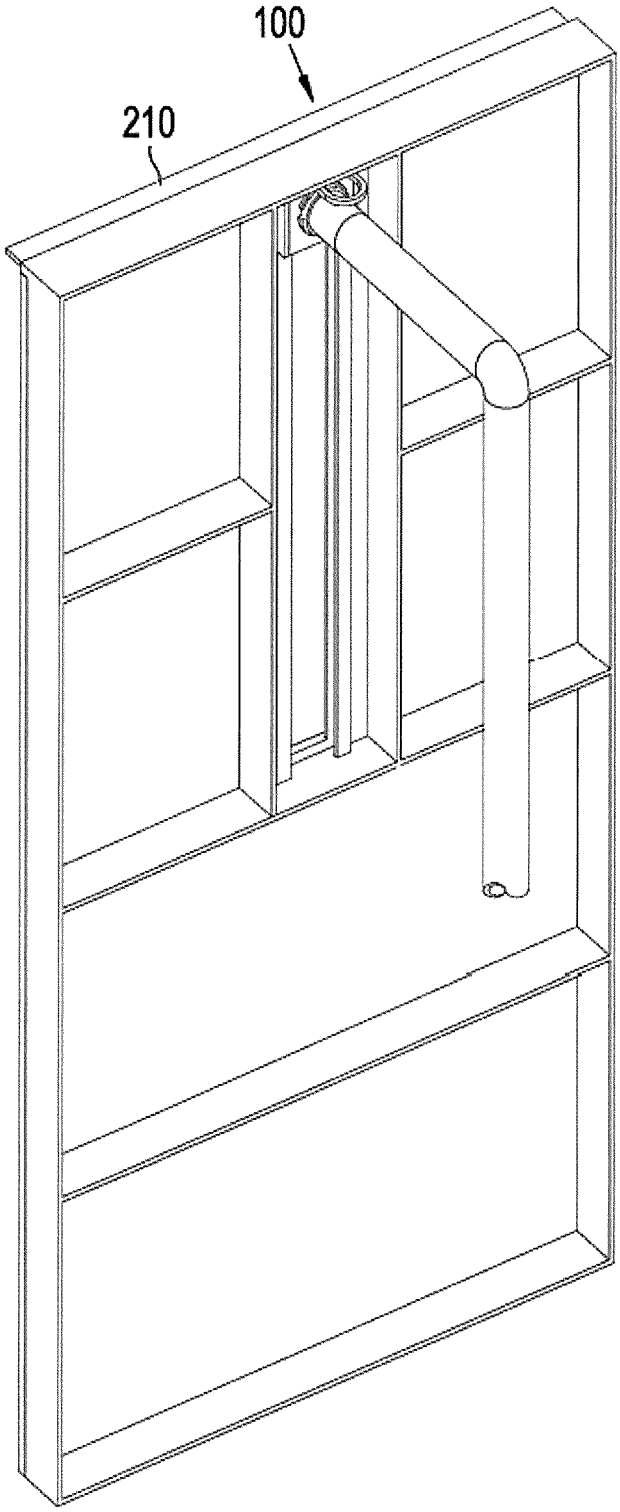

As shown in FIGS. 4C-4D, the horizontal pouring finishing plate 210 of the self-pouring apparatus 200 approaches the finishing plate-upper opening part S4 of an upper portion of the mold 100, which means that the concrete C is poured toward a front side of a side wall mold to be airtight.

In this case, the horizontal pouring finishing plate 210 protrudes toward the front side of the mold 100 and is inserted into a rear side of the mold 100 so as not to protrude.

That is, as shown in FIGS. 2K-2L, the finishing plate-upper opening part S4 is open at an upper portion of the mold 100 to be exposed. When a worker pulls the horizontal hook part 212 of the horizontal pouring finishing plate 210 toward the rear side of the the mold 100, the horizontal finishing plate 211 of the horizontal pouring finishing plate 210 is inserted into the finishing plate-upper opening part S4 while the insertion holding parts 213 are guided through the holding grooves 231 and 241 of the vertical pouring finishing plate 230 and the middle pouring pipe bracket 240, and the horizontal pouring finishing plate 210 does not protrude toward the front side of the mold 100, and thus the front of the front panel part 120 is not vertically stepped as a vertical surface.

In this case, the vertical pouring finishing plate 230 is also inserted into the front panel block out part S3 formed on the front panel part 120 to be finished.

As shown in FIG. 3, an amount of lift is adjusted by a pouring pressure adjustor 420 adjusting an amount by which the horizontal pouring finishing plate 210 is lifted (S400).

That is, as shown in FIGS. 2A and 4C-4D, an amount by which the horizontal pouring finishing plate 210 and the installation of the concrete pumping apparatus 400 are lifted is adjusted by the extension pipe member 410 of the self-pouring mold system A.

When the concrete C rises, the pouring pressure is not uniformly applied to the horizontal pouring finishing plate 210, and an upper surface of the poured concrete is not even.

For example, as shown in FIG. 2A, the pouring pressure adjustor 420 which withstands the pouring pressure like a spring is installed at any one of the reinforcing ribs 130 on a lower portion of the the mold frame part 110. When an upper end of the pouring pressure adjustor 420 is connected to the rear pouring pipe bracket 250, the horizontal pouring finishing plate 210 is lifted when the pouring pressure is greater than a predetermined level, and thus, the pouring pressure is adjusted by the pouring pressure adjustor 420 to evenly finish an upper surface of the concrete.

A pouring pressure of the pouring pressure adjustor 420 is adjusted to be less than a pouring pressure of concrete all the time, and another part that has tension instead of a spring may be used as the pouring pressure adjustor 420.

Also, the fixing plate 430 may further be installed under the pouring pipe 300 between the pouring pipe 300 and the reinforcing rib 130 to support the pouring pipe 300.

Therefore, when the self-pouring mold system A having the pouring pressure adjustor 420 is used, the pouring pipe installed to pass through the mold from the rear side of the mold to the front side thereof is lifted using a pouring pressure of concrete filled from the lower portion of the mold so that the upper surface of the mold is regularized to a pouring surface, and thus the concrete can be effectively poured. The concrete is evenly poured by determining whether the poured concrete bleeds, and when bleeding of the concrete hardly occurs, construction and quality management for a fire-proof covering of concrete is possible.

By using a self-pouring mold system of the embodiment of the present invention, quality management can be very easily performed because visual inspection is not necessary to check whether concrete is poured in a mold, construction can be effectively managed by easily finishing an upper surface after concrete is poured, concrete can be be effectively poured by being directly installed on a mold to be easily operated, whether poured concrete is poured to be airtight through a self-pouring mold system can be determined, and construction and quality management are possible for a fire-proof covering of concrete because the concrete is poured using a pouring pressure while the pouring pipe is vertically moved so that bleeding of concrete is hardly generated and concrete is evenly poured.

The above description is only exemplary, and it should be understood by those skilled in the art that the invention may be performed in other forms without changing the technological scope and essential features. Therefore, the above-described embodiments should be considered only as examples in all aspects and not for purposes of limitation. For example, each component described as a single component may be realized in a distributed manner, and similarly, components that are described as being distributed may be realized in a coupled manner.

The scope of the present invention is defined not by the detailed description but by the appended claims, and encompasses all modifications or alterations derived from the meanings, scope, and equivalents of the appended claims.

What is claimed is:

1. A method of repairing, and reinforcing concrete using a self-pouring mold system, the method comprising:

(a) providing a self-pouring mold system, wherein the self-pouring mold system includes a self-pouring mold apparatus and a pouring pipe, wherein the self-pouring mold apparatus includes:

a horizontal pouring finishing plate including a horizontal finishing plate set to a front side of a mold, and a horizontal hook part extending from the horizontal finishing plate toward a rear side of the mold through a front panel block out part;

vertical guide units transversely separated from each other on the rear side of the mold so that the front panel block out part is positioned as an opening, and installed to extend vertically;

a vertical pouring finishing plate set to the front side of the mold to finish the front panel block out part so that the horizontal hook part is supported on an upper side thereof from the rear side of the mold, and formed so that the pouring pipe passes therethrough; and a middle pouring pipe bracket positioned by the vertical guide units and set to be in contact with a rear side of the vertical pouring finishing plate so that the horizontal hook part is supported on the upper side of the mold from the rear side of the mold, and formed so that the pouring pipe passes therethrough;

(b) supplying the concrete to the pouring pipe by using a concrete pumping apparatus; and (c) inserting the horizontal pouring finishing plate toward the rear side of the mold, wherein the concrete is poured toward the front side of the front panel part of the mold and rises, and the horizontal pouring finishing plate is lifted by a concrete pouring pressure.

2. The method of claim 1, wherein the self-pouring mold apparatus includes:

the horizontal pouring finishing plate including the horizontal finishing plate set to the front side of the mold, and the horizontal hook part extending from the horizontal finishing plate toward the rear side of the mold through the front panel block out part;

the vertical guide units transversely separated from each other on the rear side of the mold so that the front panel block out part is positioned as the opening, and vertically extending;

the vertical pouring finishing plate set to the front side of the mold to finish the front panel block out part, formed so that the horizontal hook part is supported on an upper surface thereof from the rear side of the mold, and formed so that the pouring pipe passes therethrough; and the middle pouring pipe bracket positioned by the vertical guide units and set to be in contact with the rear side of the vertical pouring finishing plate so that the horizontal hook part is supported on an upper surface thereof from the rear side of the mold, and formed so that the pouring pipe passes therethrough.

3. The method of claim 2, wherein the self-pouring mold apparatus further includes a rear pouring pipe bracket whose position is restricted by the vertical guide units, and which is in contact with a rear side of the middle pouring pipe bracket, is formed so that the horizontal hook part is supported on a rear side of the mold, and is formed so that the pouring pipe passes therethrough, wherein the horizontal hook part is set to be supported on upper surfaces of the vertical pouring finishing plate, the middle pouring pipe bracket, and the rear pouring pipe bracket, and the vertical pouring finishing plate, the middle pouring pipe bracket, and the rear pouring pipe bracket are guided along the vertical guide units by the pouring pipe passing through the vertical pouring finishing plate, the middle pouring pipe bracket, and the rear pouring pipe bracket and are vertically moved at the same time.

4. The method of claim 2, wherein the vertical guide units includes:

an upper vertical guide unit formed on an upper end of the vertical guide unit to accommodate the middle pouring pipe bracket and a rear pouring pipe bracket therein; and a horizontal guide unit extending downward from a lower surface of the upper vertical guide unit to be inserted between the middle pouring pipe bracket and the rear pouring pipe bracket, wherein an upper central vertical opening part is positioned to correspond to an upper side of a central vertical opening part of the mold frame part, is installed on both sides of reinforcing ribs facing each other and positioned in the middle of the mold frame part, and is formed between the vertical guide units.

5. The method of claim 2, wherein the vertical pouring finishing plate has a vertical plate shape and includes a holding groove formed on an upper side thereof and a pouring pipe flange part protruding from a rear side thereof so that the pouring pipe passes therethrough, and is set to be attached to a vertical guide block out part of an upper central vertical opening part formed on the front panel part to be vertically moved, and when the horizontal hook part is horizontally pulled toward a rear surface of the mold, the horizontal finishing plate is guided in a finishing plate-upper opening part of the front panel part by the holding groove to be horizontally inserted therein.

6. The method of claim 2, wherein the middle pouring pipe bracket has a rectangular plate shape and includes a pouring pipe flange part protruding so that the pouring pipe passes therethrough and formed on a rear side of the middle pouring pipe bracket, wherein the pouring pipe flange part is in contact with a front side of a rear pouring pipe bracket and is separated from the rear pouring pipe bracket so that horizontal guide units of the vertical guide units are inserted between the middle pouring pipe bracket and the rear pouring pipe bracket, and a holding groove is formed on an upper surface of the middle pouring pipe bracket so that the horizontal hook part is horizontally inserted into an insertion holding part of the horizontal pouring finishing plate.

7. The method of claim 2, wherein the pouring pipe is installed to pass through the rear pouring pipe bracket, the middle pouring pipe bracket, and the vertical pouring finishing plate, and binds the rear pouring pipe bracket, the middle pouring pipe bracket, and the vertical pouring finishing plate to vertically move with the rear pouring pipe bracket, the middle pouring pipe bracket, and the vertical pouring finishing plate.

8. The method of claim 3, wherein the rear pouring pipe bracket does not have holding grooves on an upper surface thereof, and includes a clamping fixture that is separately formed on a rear side thereof to be fixedly fastened to the pouring pipe, allows a fastening fixture inserted into the pouring pipe to be rotatably fastened thereto, and protrudes so that the pouring pipe passes therethrough, and wherein the middle pouring pipe bracket has a front side which is in contact with a pouring pipe flange part of the vertical pouring finishing plate, and has a pouring pipe flange part formed on a rear surface thereof and set to be in contact with a front side of the rear pouring pipe bracket.

9. A self-pouring mold system which allows a pouring pipe installed to pass through a mold from a rear side of the mold to a front side thereof to pour concrete from a lower portion of the mold so that the concrete is uniformly poured without bleeding, the self-pouring mold system comprising:

a self-pouring apparatus installed to pass through a front panel block out part formed on the mold;

a pouring pipe installed on a front side of the mold so that the concrete is poured through the self-pouring apparatus from the rear side of the mold; and a concrete pumping apparatus installed using an extension pipe member, wherein the mold includes a mold frame part including a central vertical opening part in which reinforcing ribs are horizontally and vertically separated from each other and intersect each other, the front panel block out part is formed so that a whole front panel part is coupled to a front side thereof, and a finishing plate-upper opening part allowing a horizontal pouring finishing plate to be horizontally inserted between an upper surface of the front panel part and a lower surface of an upper plate of the mold frame part, therefore, when a worker pulls a horizontal hook part of the horizontal pouring finishing plate toward the rear side of the mold, a horizontal finishing plate is inserted into the finishing plate-upper opening part, so that the horizontal pouring finishing plate does not protrude toward the front side of the mold.

10. The self-pouring mold system of claim 9, further comprising:

insertion holding parts separated from each other, configured to protrude from a lower surface of a center of the horizontal finishing plate of the horizontal pouring finishing plate, and horizontally inserted into holding grooves formed in a vertical pouring finishing plate and a middle pouring pipe bracket;

the horizontal hook part formed to have an extended horizontal U-shape on a rear surface of the center of the horizontal finishing plate; and a fixed holding part configured to protrude from a lower surface of the horizontal hook part to be collinear with the insertion holding part to be fixedly caught on a bottom of a rear pouring pipe bracket.

11. The self-pouring mold system of claim 10, wherein the self-pouring mold system includes the concrete pumping apparatus installed using the extension pipe member and further includes a pouring pressure adjustor adjusting an amount of lift of the horizontal pouring finishing plate, wherein the pouring pressure adjustor which is withstandable against a pouring pressure is installed on the reinforcing ribs located at a lower portion of the mold frame part, and an upper end of the pouring pressure adjustor is connected to the rear pouring pipe bracket to lift the horizontal pouring finishing plate when the pouring pressure is greater than or equal to a predetermined level.

* * * * *